United States Patent [19]

Wiese et al.

[11] 4,304,572

[45] Dec. 8, 1981

[54] PRODUCTION OF SOLID FUEL-WATER SLURRIES

[75] Inventors: Harry C. Wiese, San Diego, Calif.; John C. Ahlborn, deceased, late of Pomona, Calif.; by Lloyd K. Ahlborn, executor, Hollywood, Calif.

[73] Assignee: Texaco, Inc., White Plains, N.Y.

[21] Appl. No.: 854,921

[22] Filed: Nov. 25, 1977

Related U.S. Application Data

[63] Continuation of Ser. No. 699,410, Jun. 24, 1976, abandoned.

[51] Int. Cl.[3] ..... C10L 1/32

[52] U.S. Cl. ..... 44/51

[58] Field of Search ..... 44/51; 137/13

[56] References Cited

U.S. PATENT DOCUMENTS 2,346,151 4/1944 Burk et al. ..... 44/51

*Primary Examiner*—Winston A. Douglas
*Assistant Examiner*—Y. Harris-Smith
*Attorney, Agent, or Firm*—Carl G. Ries; Robert A. Kulason; Robert Knox, Jr.

[57] ABSTRACT

The pumpability of solid fuel-water slurries is improved by incorporation therein of small amounts of ammonia and a surface-active agent.

12 Claims, No Drawings

PRODUCTION OF SOLID FUEL-WATER SLURRIES

This is a continuation, of application Ser. No. 699,410, filed June 24, 1976, now abandoned.

This invention relates to the production of slurries of solid fuels in water. More particularly it is concerned with the production of slurries of finely-ground solid fuel in water in which the slurries have a high solids content but still are pumpable.

Most solid fuels, as mined, contain varying amounts of water which in some instances may range up to 40 wt. % or even higher in the case of low grade solid fuels. This water, is an undesirable constituent of the fuel, particularly in the case of fuels of high water content. If the mined solid fuel is to be transported to its place of end use by rail this means the transportation of a large amount of non-combustible material having no fuel value. If the solid fuel is to be transported by pipeline in the form of a slurry here again water trapped in the pores of the solid fuel, which takes no part in the formation of the slurry, mist again be transported. Thus a slurry containing 50 wt. % water and 50 wt. % solid fuel would contain considerably less than that amount of fuel when the fuel is measured on a dry basis.

The amount of water necessary to form a pumpable slurry depends on the surface characteristics of the solid fuel. For example, soot formed during the partial oxidation of a carbonaceous material has such a high surface area that a concentration of such soot in water in excess of a few wt. % renders the resulting slurry unpumpable. In the case of a slurry which is to be fed to a gas generator, it is necessary that the solid fuel be ground to such an extent that a major portion thereof will pass through a 200 mesh sieve so that the particles are small enough to be substantially completely converted to oxides of carbon during their short residence time within the gasification zone. However, ordinarily before reaching the gasification zone the slurry must pass through various pieces of equipment such as heat exchangers and compressors on its way from the slurry zone to the gas generation zone. Accordingly, the slurry must be pumpable but in the case of a slurry made up of solid fuel particles most of which will pass through a 200 mesh sieve it has been found that ordinarily, a pumpable slurry must contain from about 55 to 60 wt. % water. Unfortunately a slurry containing this amount of water renders the operation of the gasifier unsatisfactory as this excessive amount of water moderates the temperature of the reaction zone to such an extent that its thermal efficiency is seriously impaired. It has been found that a suitable amount of water in a solid fuel-water slurry which is to be used as feed to a gas generation zone is between about 40 and 50 wt. % preferably between 40 and 45 wt. %.

It is therefore an object of this invention to produce solid fuel water slurries having a relatively high solids content. Another object is to produce solid fuel-water slurries suitable for use as feed to a solid fuel gasification zone. Still another object of the invention is to produce pumpable slurries of solid fuel in water wherein a major portion of the solid fuel will pass through a 200 mesh sieve and in which the water content of the slurry will range between about 40 and 50 wt. %. These and other objects wlll be obvious to those skilled in the art from the following disclosure.

According to our invention there is provided a process for the production of a solid fuel-water slurry of improved pumpability characteristics which comprises forming a solid fuel-water slurry containing $NH_4OH$ in an amount between about 0.1 and 5 wt. % and also containing an anionic surface active agent comprising a salt of an organic sulfonic acid in an amount between 0.01 and 3.0 wt. %, said amounts being based on the final weight of the slurry.

Any solid fuel such as lignite, sub-bituminous coal, bituminous coal, anthracite and coke and mixtures thereof may be used in the process of our invention although our process is more particularly adapted to use with lower grade fuels such as sub-bituminous coal and lignite. The solid fuel should be in finely-divided form so that at least 50 wt. % and preferably at least 80 wt. % passes through a 200 mesh sieve (U.S. standard).

Although it is possible to use gaseous $NH_3$ which combines with the slurry water to form $NH_4OH$, it is more convenient to use concentrated ammonium hydroxide. It has also been found that $NH_4OH$ for our purposes, is superior to other bases such as KOH. The $NH_4OH$ should be present in the slurry in an amount between about 0.1 and 5.0 wt. % preferably between 0.2 and 3.0 wt. % based on the final weight of the slurry.

While any surface active agent may be used to some extent in the process of our invention, it has been found that anionic surface active agents comprising an alkali metal or alkaline earth metal salt of an organic sulfonic acid is superior, for the purposes of our invention, to other types of surface active agents. Examples of particularly suitable surface active agents are the calcium, sodium and ammonium salts of organic sulfonic acids such as 2,6-dihydroxynaphthalene sulfonic acid and lignin sulfonic acid. In this connection ammonia is considered as an alkali metal. The surface active agent should be present in the slurry in an amount between 0.01 and 3.0 wt. % based on the final weight of the slurry, preferred amounts being between 0.1 and 2.0 wt. %.

The ammonia may be added as a gas in which case it will dissolve in the slurry water or it may be added as ammonium hydroxide solution preferably in concentrated form as 28% $NH_3$ or 58% $NH_4OH$. In the following examples, any water added to the slurry is used to calculate the total weight of the slurry. In some instances, solid fuel has also been added to the slurry to keep the percentage of solids constant for true comparison purposes.

The following examples are submitted for illustrative purposes only and it should not be construed that the invention is restricted thereto. Although in the examples the ammonia and surface active agent are added after formation of the slurry, it will be appreciated that it is their presence in the slurry that results in the viscosity being lower than in their absence. It is therefore within the contemplation of the invention that the slurry may be made with ammoniated water or that the ammonia may be added to the water simultaneously with the solid fuel. Similarly the surface active agent may be added to the water prior to or during the addition of the solid fuel and ammonia to the water.

EXAMPLE I

The coal used in this example was a dried Kentucky coal having the following sieve analysis:

TABLE 1

| Sieve # | Wt. % |
|---|---|
| 40 | 0.08 |
| 60 | 0.08 |
| 80 | 0.12 |
| 100 | 0.28 |
| 150 | 1.92 |
| 200 | 3.56 |
| 230 | 7.28 |
| 325 | 22.20 |
| −325 | 64.48 |

A slurry containing 51.9 wt. % of the dry coal in water was prepared and various additives were introduced into separate portions of the slurry. Viscosities were determined on a Stormer viscosimeter and are reported in centipoises. Experimental data appear below.

TABLE 2

| Additive | Wt. % of Total Slurry | Viscosity |
|---|---|---|
| none | — | 214 |
| A | 0.03 | 194 |
| A | 0.13 | 152 |
| A | 0.20 | 145 |
| A | 0.33 | 108 |
| B | 0.33 | 105 |
| $NH_4OH$ | 1.93 | 140 |
| $NH_4OH$ + A | 1.93, 0.03 | 124 |
| $NH_4OH$ | 0.97 | 155 |
| $NH_4OH$ + A | 0.97, 0.03 | 115 |
| $NH_4OH$ + A | 0.97, 0.07 | 105 |
| KOH | 1.93 | 214 |
| KOH + A | 1.93, 0.03 | 195 |
| $NH_4OH$ + B | 0.97, 0.33 | 96 |

A = sodium lignin sulfonate
B = sodium salt of 2,6-dihydroxynaphthalene sulfonic acid

EXAMPLE II

In this example the same coal used in Example I was formed into a coal-water slurry containing 49.1 wt. % solids measured on a dry basis. The viscosity of the slurry and those of the slurry with various additives are shown below.

TABLE 3

| Additive | Wt. % of Total Slurry | Viscosity |
|---|---|---|
| none | — | 144 |
| $NH_4OH$ | 0.23 | 114 |
| $NH_4OH$ + C | 0.23, 0.10 | 99 |
| C | 0.10 | 106 |

C = ammonium lignin sulfonate

The foregoing data show that $NH_4OH$ is unexpectedly superior to KOH in reducing the viscosity of the slurry and also shows the superior results obtained by the combination of $NH_4OH$ and the surface active agent. By the use of these additives it is possible to increase the solids content of the solid fuel-water slurry and still retain pumpability.

EXAMPLE III

In this example the solid fuel is Kentucky bituminous coal having the following sieve analysis:

TABLE 4

| U.S. Standard Sieve | Wt. % Retained |
|---|---|
| 40 | 0 |
| 60 | 0 |
| 100 | 0.16 |
| 150 | 3.32 |
| 200 | 10.0 |

TABLE 4-continued

| U.S. Standard Sieve | Wt. % Retained |
|---|---|
| 230 | 11.12 |
| 325 | 40.36 |
| 400 | 15.56 |
| −400 | 19.48 |

The Stormer viscosities of water slurries of various compositions are reported below:

TABLE 5

| Wt. % Dry Solids | Additive | Wt. % of Slurry | Viscosity |
|---|---|---|---|
| 55 | — | — | 769 |
| 55.06 | KOH | 0.2 | 683 |
| 55.14 | KOH, C | 0.6, 0.1 | 695 |
| 52.8 | — | — | 490 |
| 52.8 | KOH | 0.2 | 478 |
| 52.8 | KOH, C | 0.2, 0.1 | 510 |
| 52.8 | A | 0.2 | 427 |
| 52.8 | KOH, A | 0.2, 0.2 | 486 |

A = sodium lignin sulfonate
C = ammonium lignin sulfonate

These data in the foregoing examples show that, as might be expected, the addition of a surface active agent lowers the viscosity of the slurry but it was not to be expected that the addition of ammonia to the slurry containing the surface active agent would result in a further reduction in the viscosity. They also show that KOH unlike ammonia, has the opposite effect in that when KOH is added to a slurry containing a surface active agent, there is an increase in the viscosity.

EXAMPLE IV

In this example, the same coal was used as in Example I. The Stormer viscosities of water slurries of various compositions are tabulated below:

TABLE 6

| Wt. % Dry Solids | Additive | Wt. % of Slurry | Viscosity |
|---|---|---|---|
| 51.9 | — | — | 214 |
| 51.9 | $(NH_4)_2S$ | 1.83 | 220 |
| 51.9 | $(NH_4)_2CO_3$ | 2.0 | 234 |
| 51.9 | $NH_4OH$ | 1.93 | 140 |

It will be noted that the addition of $NH_4OH$ resulted in a decrease in the viscosity of the slurry and that the addition of $(NH_4)_2S$ or $(NH_4)_2$ $CO_3$ resulted in an increase in the viscosity of the slurry.

The foregoing data show that $NH_4OH$ is unexpectedly superior to KOH in reducing the viscosity of the slurry and also shows the superior results obtained by the combination of $NH_4OH$ and the surface active agent. By the use of these additives it is possible to increase the solids content of the solid fuel-water slurry and still retain pumpability.

Various modifications of the invention as hereinbefore set forth may be made without departing from the spirit and scope thereof, and therefore, only such limitations should be made as are indicated in the appended claims.

We claim:

1. A process for improving the pumpability of a high solids content water slurry of a solid fuel selected from the group consisting os sub-bituminous coal and lignite which comprises forming a water slurry of said solid fuel containing at least 50% solids by weight, said slurry also containing $NH_4OH$ in an amount between 0.1 and 5.0 weight percent and also containing an anionic surface-active agent comprising a salt of an organic sulfonic acid in an amount between 0.01 and 3.0 weight percent, said amounts being based on the final weight of the slurry.

2. The process of claim 1 in which the solid fuel is lignite.

3. The process of claim 1 in which the solid fuel is sub-bituminous coal.

4. The process of claim 1 in which at least 50 wt. % of the solid fuel passes through a 200 mesh sieve.

5. The process of claim 1 in which at least 80 wt. % of the solid fuel passes through a 200 mesh sieve.

6. The process of claim 1 in which the organic sulfonic agent is 2,6-dihydroxynaphthalene sulfonic acid.

7. The process of claim 1 in which the organic acid is lignin sulfonic acid.

8. The process of claim 1 in which the salt of the organic sulfonic acid is a calcium salt.

9. The process of claim 1 in which the salt of the organic sulfonic acid is sodium.

10. The process of claim 1 in which the salt of the organic sulfonic acid is ammonium.

11. The process of claim 1 in which the slurry contains between about 40 and 50 wt. % water.

12. The process of claim 11 in which the slurry contains between about 40 and 45 wt. % water.

* * * * *